United States Patent [19]

Peterson et al.

[11] 4,134,744

[45] Jan. 16, 1979

[54] FINE PARTICULATE CAPTURE DEVICE

[75] Inventors: Victor S. Peterson, Brunswick; Robert D. Siewert, Sandusky, both of Ohio

[73] Assignee: The United States of America as represented by the Administrator of the National Aeronautics and Space Administration, Washington, D.C.

[21] Appl. No.: 414,042

[22] Filed: Nov. 8, 1973

[51] Int. Cl.[2] ..... B03C 3/78

[52] U.S. Cl. ..... 55/118; 55/122; 55/127; 55/155; 55/241; 55/242; 55/360; 55/407

[58] Field of Search ..... 55/118, 120, 122, 124, 55/126, 127, 142, 149, 155, 238, 407, 220, 241, 242, 360

[56] References Cited

U.S. PATENT DOCUMENTS

| | | | |
|---|---|---|---|
| 2,709,954 | 6/1955 | Baker | 55/126 UX |
| 2,776,724 | 1/1957 | Goldschmied | 55/124 |
| 3,033,643 | 5/1962 | Janes | 55/122 UX |
| 3,384,446 | 5/1968 | Ziems et al. | 55/122 X |
| 3,401,503 | 9/1968 | Bergstrom | 55/122 X |
| 3,444,667 | 5/1969 | Mullin | 55/122 X |
| 3,804,942 | 4/1974 | Kato et al. | 55/126 X |

*Primary Examiner*—Frank W. Lutter
*Assistant Examiner*—Kathleen J. Prunner
*Attorney, Agent, or Firm*—N. T. Musial; J. R. Manning; J. A. Mackin

[57] ABSTRACT

To capture fine particulate matter in a gas such as air, a dielectric fluid is directed to the center of whichever face of a rotating disc is exposed to the air flow. The disc is comprised of two or more segments which bear opposite electrostatic potentials. As the dielectric fluid is centrifuged towards the periphery of the rotating disc, the fluid becomes charged to the same potential as the segment over which it is passing. Particulate matter is attracted to the charged segment and is captured by the fluid. The fluid then carries the captured particulate matter to a collection device such as a toroidal container disposed around the periphery of the disc. A grounded electrically-conductive ring may be disposed at the outer periphery of the disc to neutralize the captured particles and the fluid before they enter the container.

9 Claims, 1 Drawing Figure

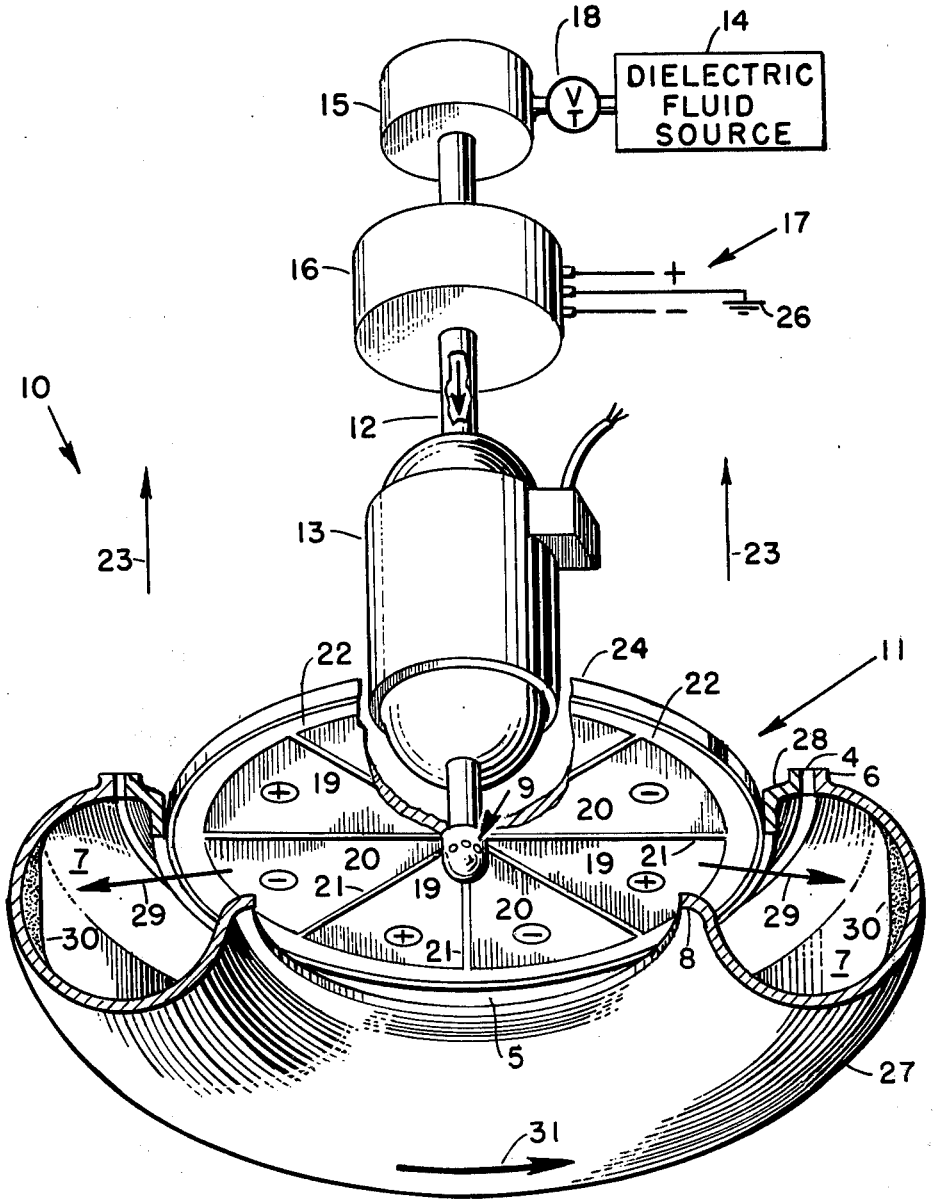
18
14
DIELECTRIC FLUID SOURCE
V
T
15
17
16
+
−
26
10
12
13
23
23
22
24
22
11
28
4
6
19
9
20
20
7
21
19
21
29
29
30
30
19
20
21
8
7
5
27
31

FINE PARTICULATE CAPTURE DEVICE

ORIGIN OF THE INVENTION

This invention was made by Government employees and may be manufactured and used by or for the Government of the United States without the payment of any royalties thereon or therefor.

BACKGROUND OF THE INVENTION

This invention relates to environmental pollution measuring devices and is directed more particularly to a device for collecting or capturing sub-micron size gas-borne or air-borne particulates.

In recent years, since air pollution around large urban centers and elsewhere has become a national concern, all levels of Government have enacted laws and established requirements for maximum allowable pollution levels of gases and solids. Accordingly, there is a need for apparatus for quickly, economically and accurately measuring pollutants in the air.

To measure the solid matter of particulates in the air, known volumes of air samples are directed through filters which capture the particulate matter. However, these filters do not capture extremely small particles and particularly those of sub-micron size. Moreover, if these sub-micron particles are captured in the conventional filter, it is difficult, if not impossible, to remove them from the filter element material for analysis.

OBJECTS AND SUMMARY OF THE INVENTION

It is an object of the invention to provide apparatus which will capture sub-micron size particulate matter from a gas such as air for accurate quantitative and qualitative analysis.

It is another object of the invention to provide a particular capture device which does not require renewal or replacement of parts after each sample collection.

It is still another object of the invention to provide a particulate capture device for sub-micron particles which may be operated in conjunction with a filter which captures the larger particles.

Yet another object of the invention is to provide a particulate collection device which stores the collected matter in such a way that it is rapidly and easily removed for evaluation.

In summary, the instant invention provides apparatus for collecting sub-micron airborne particles which would be lost within normal filters and which provides, as part of the invention, a container for the collected particulate matter.

BRIEF DESCRIPTION OF THE DRAWINGS

The single FIGURE is a partially cutaway, oblique pictorial view of a capture device embodying the invention.

DESCRIPTION OF A PREFERRED EMBODIMENT

Referring now to the single figure, there is shown a fine particulate capture device 10 which includes a disc 11 disposed at one end of a hollow shaft 12. The hollow shaft 12 is rotated by an electric drive motor 13 through which shaft 12 extends. A dielectric fluid which is non-reactive with the particulate matter of interest and preferably of low viscosity is directed downwardly through the hollow shaft 12 via a rotary union 15 from a source of dielectric fluid 14. Suitable fluids include but are not limited to hydrocarbons, silicon oils, synthetic oils and deionized water.

Electrostatic potentials as at 17 are directed to the disc 11 by means of an electrostatic potential slip-ring assembly 16.

To control the rate of flow of dielectric fluid being supplied to disc 11, a throttle valve 18 may be disposed between the fluid source 14 and the rotary union 15. The throttle valve 18 is adjusted to determine the rate of capture fluid flow such that a thin layer covers the surface of disc 11 exposed to the contaminated air. The fluid and captured particulate matter then is centrifuged toward the periphery of the disc 11 which is being rotated by the drive motor 13.

The disc 11 is comprised of a plurality of mutually isolated, positive sections 19 and negative sections 20 having a generally wedge-shaped configuration. The sections 19 and 20 are of an electrically-conductive material such as metal or various types of conductive plastics. It will be understood that materials used for the segments 19 and 20 must be inert with respect to the dielectric fluid being used. The conductive segments 19 and 20 are separated by dielectric spokes 21 and subtended by a peripheral dielectric rim 22.

The disc 11 may be made by inserting conductive segments 19 and 20 into a dielectric spoked wheel comprised of a rim 22 and spokes 21. Preferably, the disc is made from a dielectric disc having a thin metal layer thereon by utilizing well-known circuit etching techniques to remove the metal layer in the areas defined as spokes 21 and rim 22.

As mentioned previously, a dielectric fluid flows at a rate determined by throttle valve 18. The dielectric fluid is dispensed through apertures 9 near the lower end of hollow shaft 12 and distributed on the lower surface of the disc 11. The rotating speed of the disc 11 and the flow rate of the capture fluid through the throttle valve 18 must be adjusted to assure an even flowing film of fluid over the entire exposed area of the disc 11.

The speed of the drive motor 13 and the adjustment of the throttle valve 18 depend on the viscosity of the selected capture fluid. The centrifugal force imparted to the fluid must overcome the forces of gravity that would tend to separate the fluid from the disc 11 surface area.

Particles carried in an effluent gas or air sample flowing in the direction as indicated by arrows 23 are directed by flow velocity and subsequently attracted to the electrostatically charged sections 19 and 20. As the particles approach the sections 19 and 20, they contact the flowing fluid and are captured thereby. Thus, the particles are centrifuged towards the periphery of disc 11 in the dielectric fluid and are collected in a torus container as will be described presently.

As the particles are centrifuged with the dielectric fluid, they may obtain varying degrees of electrostatic potentials. This is undesirable in that particles that have opposite charges would attract to form an agglomerate mass. This would spoil the analysis as to population density and size of the particles. Accordingly, it is desirable to neutralize the captured particles before they are collected. To this end, an electrically-conductive ring 24 is disposed at the rim of disc 11 and serves as a charge neutralizer means. The ring 24 is connected to a ground neutral as at 26 via a connective wire (not shown) and the slip ring assembly 16.

In order to collect the particulate-bearing centrifuged fluid, a hollow torus 27 is attached by bolts or other suitable means to the neutralizing ring 24, as shown by means of an upper, inner rim 6 which is attached by bolts or other suitable means to an annular mounting ring 28. A lower, inner rim 8 of the torus is spaced below the lower surface of the disc 11 to form an annular slot 5 which receives the centrifuged fluid from the disc. Torus 27 forms an annular chamber 7.

The arrows 29 indicate the direction of the fluid flow from the disc 11 into the torus 27 while the disposition of the fluid in the torus is indicated at 30. Arrow 31 indicates the direction of rotation of the disc 11 and the torus 27 although it will be obvious that the torus and the disc can rotate in the opposite direction.

From the foregoing, it will be seen that the invention provides apparatus for capturing particulate matter from a gas by flowing a dielectric fluid across a rotating disc having charged segments which attract particulate matter. This causes the particulate matter to be captured in the fluid and centrifuged into a container disposed around the periphery of the rotating disc.

It will be understood that those skilled in the art may change or modify the invention as described above without departing from the spirit and scope of the invention, as set forth in the claims appended hereto.

What is claimed is:

1. Apparatus for capturing particles in a gas, said apparatus comprising:

a disc including at least two sections, each section bearing an electrical potential of opposite polarity to an adjacent section;

means for rotating said disc about an axis perpendicular to its surface;

means for directing a dielectric collector fluid to the center of said disc;

means for controlling the flow rate of said dielectric fluid such that it flows in a continuous film toward the edge of said disc, and means for collecting the fluid being centrifuged from said disc, said dielectric fluid being inert with respect to said sections and non-reactive with respect to said particles.

2. The apparatus of claim 1 and including a ring of electrically conductive material disposed at the periphery of said disc in spaced relationship to said sections to neutralize the dielectric liquid and any charged particles contained therein.

3. The apparatus of claim 2 wherein said ring is at an electric potential intermediate the opposite potentials of the respective sections.

4. The apparatus of claim 1 wherein said dielectric fluid is selected from the group consisting of hydrocarbons, silicon oils, synthetic oils and deionized water.

5. The apparatus of claim 1 wherein said sections comprise metallic foils attached to a dielectric material.

6. The apparatus of claim 1 wherein said means for collecting the dielectric fluid comprises a torus having annular slot defined by a lower inner rim and the disc, the periphery of said disc being inside said torus.

7. The apparatus of claim 6 wherein said torus is attached to and rotates with said disc.

8. The apparatus of claim 6 wherein said torus is at an electric potential intermediate the respective opposite potentials of the sections comprising said disc.

9. The structure of claim 1 wherein said sections are wedge-shaped, each section being of a polarity opposite to the polarity of each adjacent section.

* * * * *